US006227937B1

(12) United States Patent
Principe

(10) Patent No.: US 6,227,937 B1
(45) Date of Patent: May 8, 2001

(54) THIGH ANTI-CHAFING GARMENT

(76) Inventor: Ivis N. Principe, 65 Mary's Fancy P.O. Box 729, Kingshil St Croix, VI (US) 00851

( * ) Notice: Subject to any disclaimer, the term of this patent is extended or adjusted under 35 U.S.C. 154(b) by 0 days.

(21) Appl. No.: 09/559,999

(22) Filed: Apr. 28, 2000

Related U.S. Application Data

(60) Provisional application No. 60/146,781, filed on Jul. 31, 1999.

(51) Int. Cl.[7] ..... A41C 1/00

(52) U.S. Cl. ..... 450/153; 2/407; 450/100; 450/142

(58) Field of Search ..... 2/22, 23, 24, 61, 2/62, 240, 303, 409; 450/94; 128/289, 149

(56) References Cited

U.S. PATENT DOCUMENTS

| | | | | |
|---|---|---|---|---|
| 2,674,997 | * | 4/1954 | Haas | 128/149 |
| 3,094,990 | * | 6/1963 | Neilson | 128/289 |
| 3,934,583 | * | 1/1976 | Hollingshead et al. | 128/165 |
| 4,709,692 | * | 12/1987 | Kirschenberg | 128/78 |
| 6,079,050 | * | 6/2000 | Hooper-Jackson | 2/78.1 |

* cited by examiner

*Primary Examiner*—John J. Calvert
*Assistant Examiner*—Alissa L. Hoey
(74) *Attorney, Agent, or Firm*—Donald A. Kettlestrings

(57) ABSTRACT

A thigh anti-chafing garment to be worn with ordinary undergarments as a supplemental undergarment. The thigh anti-chafing garment includes sleeve members for removably and adjustably positioning around the thighs of a human. The sleeve members are adjustably suspended from a belt or other support adjustably positioned around the waist of the wearer by a plurality of additional supports or straps which are connected between the belt and the sleeve members.

16 Claims, 4 Drawing Sheets

THIGH ANTI-CHAFING GARMENT

This application claims benefit to Provisional Application 60/146,781 filed Jul. 31, 1999.

BACKGROUND OF THE INVENTION

This invention relates to garments and more particularly to a thigh anti-chafing garment to be worn as an undergarment to prevent chafing of the wearer's thighs.

Obese persons and persons with large thighs frequently experience chafing of the thighs as the thighs rub together. This problem can be particularly acute during hot and humid weather and when certain types of clothing, such as dresses or skirts, are worn which do not cover or otherwise protect the inner thighs from rubbing together during normal everyday activities.

BRIEF SUMMARY OF THE INVENTION

It is, therefore, an object of the present invention to provide a thigh anti-chafing garment.

Another object is to provide such a garment which can be worn along with ordinary undergarments as a supplemental undergarment.

A further object of the invention is the provision of such a garment which will enable the wearer to wear outer garments which could not otherwise be comfortably worn without chafing of the wearer's thighs.

Still another object is to provide such a garment which can be quickly and easily positioned on the wearer and removed from the wearer.

A still further object is to provide such a garment having sleeve members which are quickly and easily adjustable in size to comfortably accommodate thighs of different sizes and to enable the sleeve members to fit loosely or tightly around the wearer's thighs, as desired.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects, the present invention provides a thigh anti-chafing garment, comprising: first and second sleeve members for positioning around the thighs of a human wearer; a first connector attached to the first sleeve member for enabling adjustment of the fit of the first sleeve member around a first thigh of the human wearer; a second connector attached to the second sleeve member for enabling adjustment of the fit of the second sleeve member around a second thigh of the human wearer; a first support or belt for positioning around the waist of the human wearer; and additional supports or straps connected between the first support or belt and the first and second sleeve members for supporting the sleeve members at desired locations around the thighs of the wearer.

It is to be understood that both the foregoing general description and the following detailed description are exemplary and explanatory but are not restrictive of the invention.

BRIEF DESCRIPTION OF THE SEVERAL VIEWS OF THE DRAWINGS

The accompanying drawings, which are incorporated in and constitute a part of this specification, illustrate preferred embodiments of the invention and, together with the description, serve to explain the principles of the invention.

DETAILED DESCRIPTION OF THE INVENTION

Figure 1:
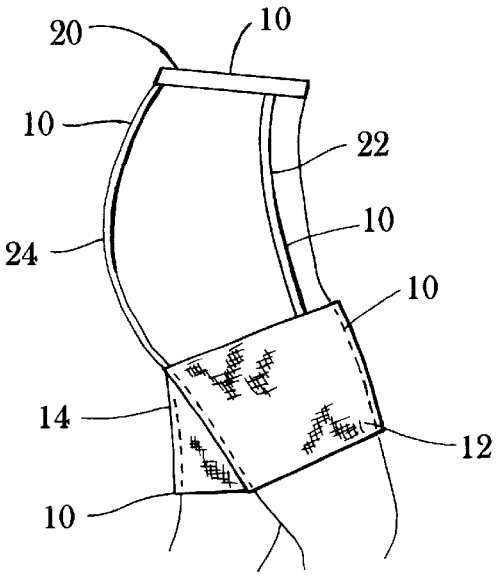
FIG. 1 is a side elevation view showing the thigh anti-chafing garment in use.
Figure 2:
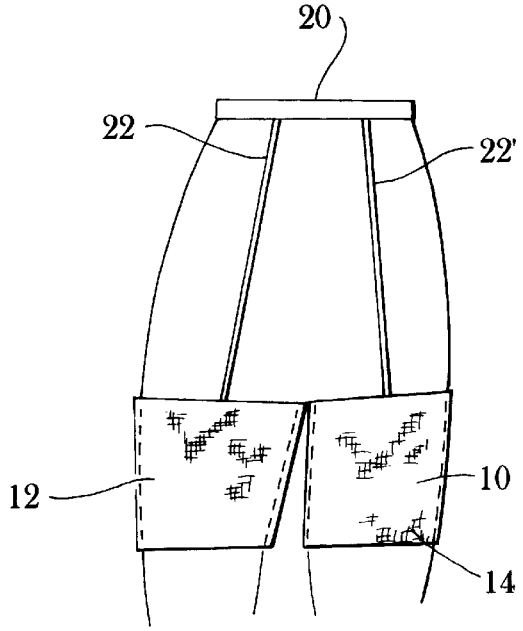
FIG. 2 is a front elevation view showing the garment in use.
Figure 3:
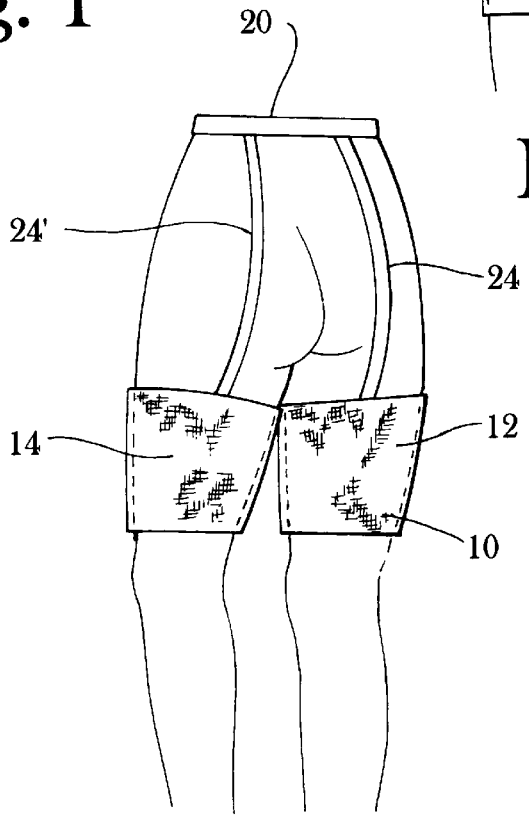
FIG. 3 is a rear elevation view showing the garment in use.

With reference now to the drawings, wherein like reference characters designate like or corresponding parts throughout the several views, there is shown in FIGS. 1–3 a thigh anti-chafing garment 10 in accordance with this invention. Garment 10 includes first and second sleeve members 12, 14 for positioning around the thighs of a human wearer. Sleeve members 12, 14 are constructed of conventional natural or artificial fabric.

Garment 10 further includes first means or a first connector 16 (see FIG. 5) in operative relationship with or attached to first sleeve member 12 for enabling adjustment of the fit of sleeve member 12 around a first thigh of the human wearer to enable sleeve member 12 to fit tightly or loosely around the first thigh.

Garment 10 also includes second means or a second connector 18 (see FIG. 6) in operative relationship with or attached to second sleeve member 14 for enabling adjustment of the fit of sleeve member 14 around a second thigh of the human wearer to enable sleeve member 14 to fit tightly or loosely around the second thigh.

In accordance with the invention, garment 10 further includes a first support or belt 20 for adjustably positioning around the waist of the human wearer, and additional supports or straps 22, 22', 24 and 24' connected between support or belt 20 and sleeve members 12, 14 for supporting the sleeve members around the thighs at desired locations on the thighs of the human wearer.

Support or belt 20 may be a conventional elastic or adjustable belt, and supports or straps 22, 22', 24 and 24' may be conventional elastic or adjustable straps.

First sleeve member 12 (FIG. 5) includes first fabric material 26 of natural or artificial fabric defining first and second opposed sides 28, 30 and further defining upper and lower edges 32, 34 and first and second opposed side edges 36, 38 extending between upper and lower edges 32, 34. First connector or first means 16 includes a first element 40 attached in a conventional manner, such as by sewing, to first side 28 adjacent to first side edge 36. First connector or first means 16 further includes a second element 42 attached in a conventional manner to second side 30 adjacent to second side edge 38 and in operative relationship with first element 40 for enabling selective connection and disconnection of elements 40, 42 and for enabling adjustment of the fit of first sleeve member 12 around a first thigh of the human wearer.

Second sleeve member 14 (FIG. 6) similarly includes second conventional fabric material 26' defining first and second sides 28', 30' and further defining upper and lower edges 32', 34' and first and second opposed side edges 36', 38' extending between upper and lower edges 32', 34'.

Second connector 18 includes a first element 40' attached in a conventional manner to first side 28' of fabric material 26' adjacent to first side edge 36'. Second connector 18 further includes a second element 42' attached in a conventional manner to second side 30' of fabric material 26' adjacent to second side edge 38' and in operative relationship with first element 40' for enabling selective connection and disconnection of elements 40', 42' and for enabling adjustment of the fit of second sleeve member 14 around a second thigh of the human wearer.

First connector 16 (FIG. 5) preferably further includes a third element 44 conventionally attached to second side 30 of first fabric material 26 in spaced-apart relationship with second side edge 38 for enabling selective connection and disconnection of elements 40 and 44 to permit adjustment of the fit of first sleeve member 12 around the first thigh of the human wearer.

Figure 6:
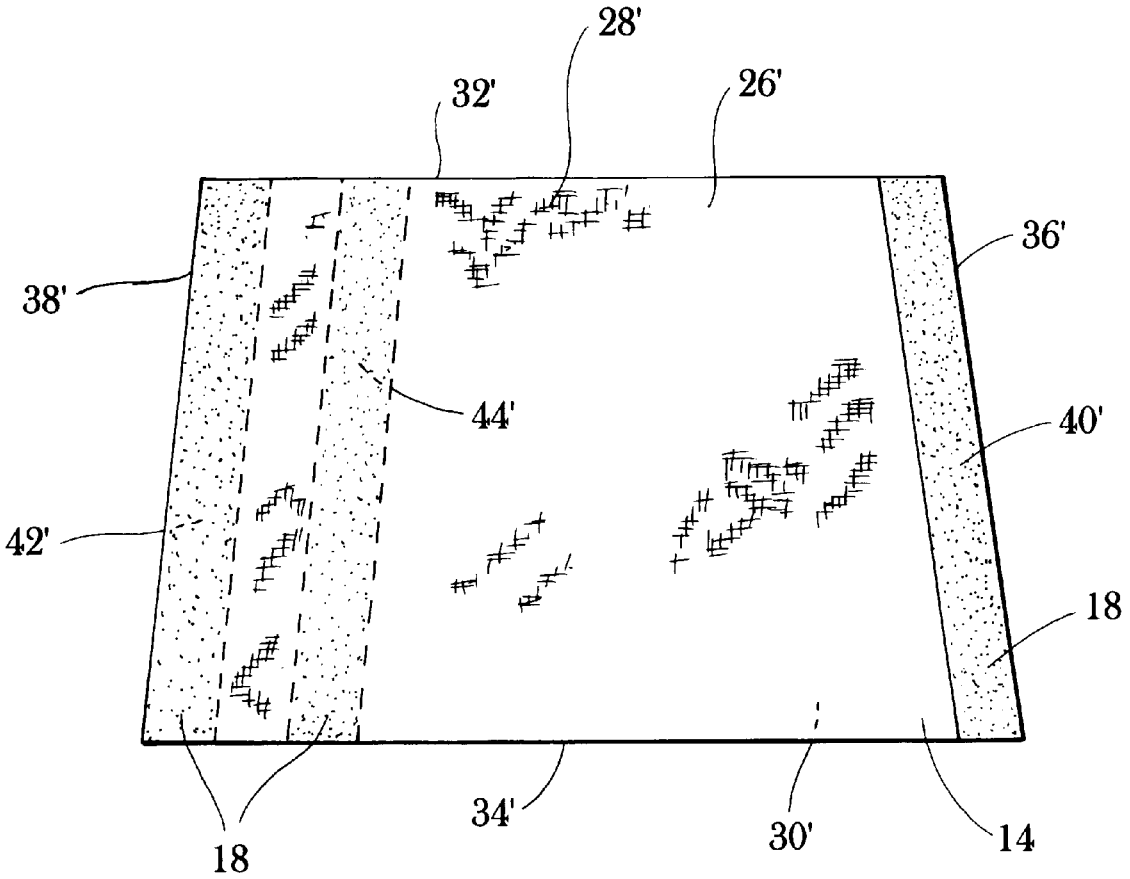
FIG. 6 is a front elevation view showing a second sleeve member of the embodiment shown in FIG. 5 in an open position.

FIG. 6 illustrates the structure of second sleeve member 14, which is similar to the structure of sleeve member 12 previously described. Second connector 18 of second sleeve member 14 also preferably further includes a third element 44' conventionally attached to second side 30' of second fabric material 26' in spaced-apart relationship with second side edge 38' for enabling selective connection and disconnection of elements 40' and 44' to permit adjustment of the fit of second sleeve member 14 around a second thigh of the human wearer.

Figure 4:
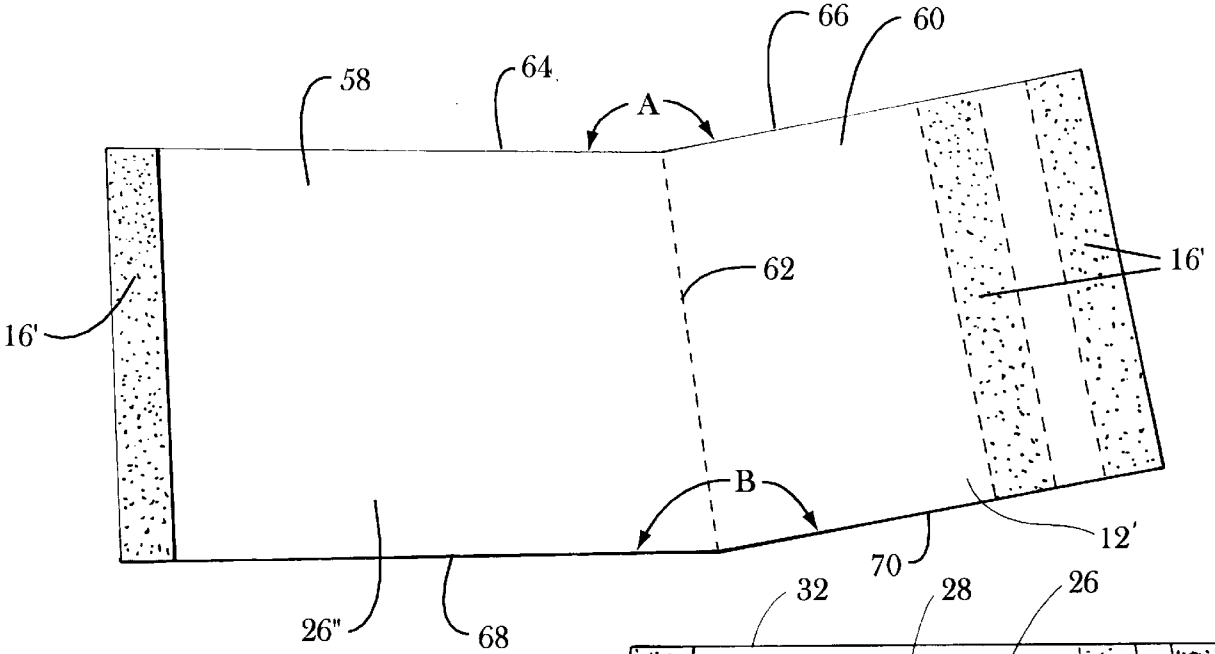
FIG. 4 is a front elevation view of one embodiment of the invention shown in an open configuration.
Figure 5:
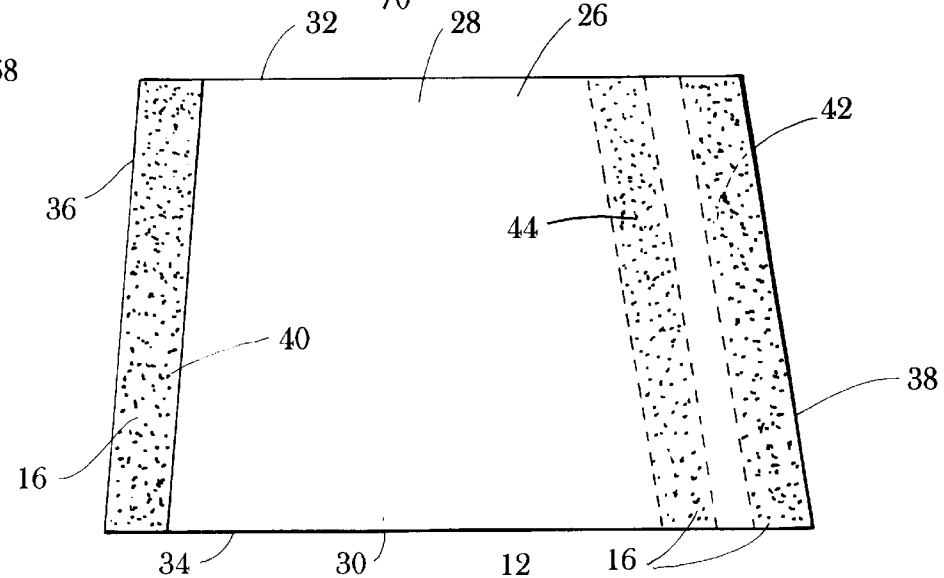
FIG. 5 is a front elevation view showing a first sleeve member of another embodiment of the invention in an open configuration.
Figure 7:
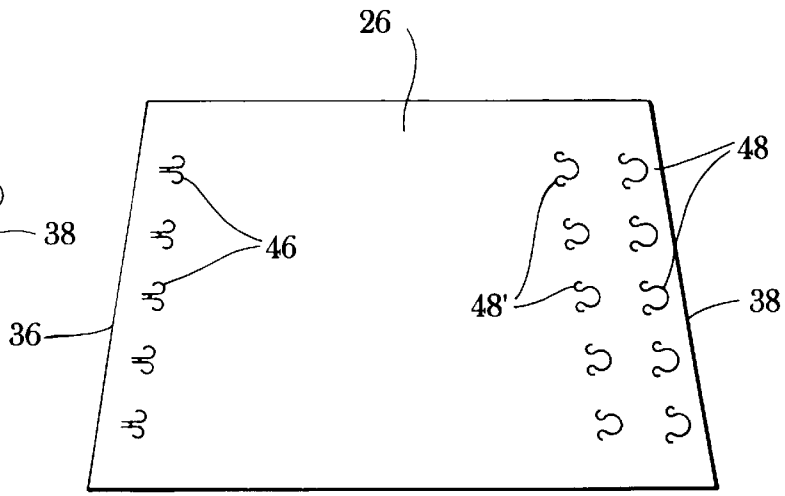
FIG. 7 is a front elevation view showing a first sleeve member of another embodiment of the invention in an open configuration.
Figure 8:
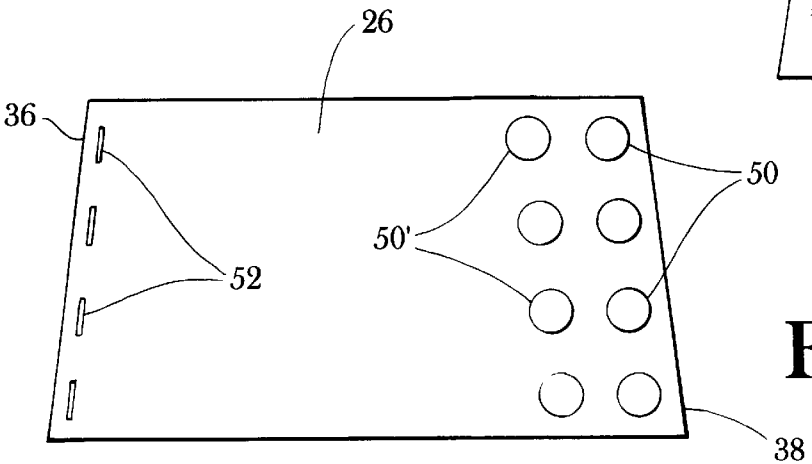
FIG. 8 is a front elevation view showing a first sleeve member of still another embodiment of the invention in an open configuration.

Various types of conventional connectors 16, 18 can be used with garment 10. A hook and loop type material, such as Velcro®, can be used for connectors 16, 18, as shown in FIGS. 4–6. Connectors 16, 18 can alternatively be comprised of hooks 46 and eyes 48, 48', as shown in FIG. 7. Another alternative configuration is illustrated in FIG. 8 wherein connectors 16, 18 are comprised of buttons 50, 50' and button holes 52 defined in the fabric.

Figure 9:
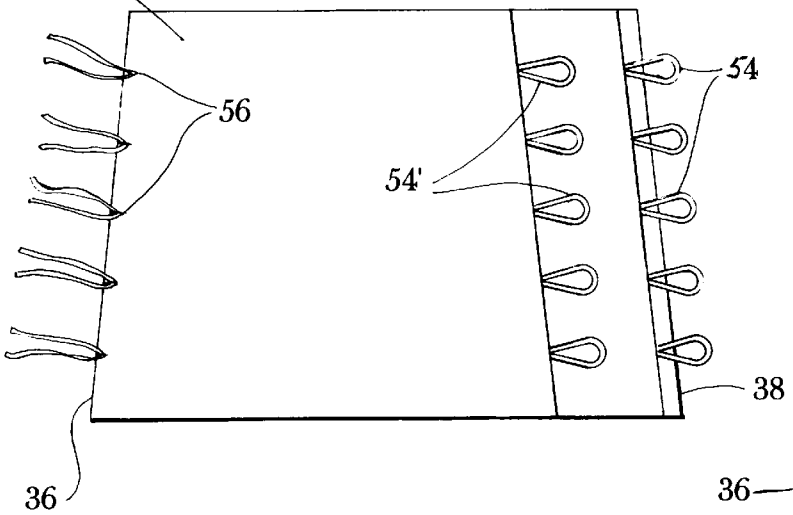
FIG. 9 is a front elevation view showing a first sleeve member of another embodiment of the invention in an open configuration.

Still another embodiment is illustrated in FIG. 9 wherein connectors 16, 18 are each comprised of loops 54, 54' and tie elements, such as ribbons or strings 56.

Multiple rows of eyes 48, 48' and/or hooks 46, buttons 50, 50' and/or button holes 52 and loops 54, 54' and/or ribbons or strings 56 may be provided for enabling adjustment of the fit of sleeve members 12, 14 around the wearer's thighs.

It should be understood that various additional types of conventional connectors, not shown and described herein, can be used as connectors 16, 18.

Embodiments of garment 10 shown in FIGS. 5–9 provide for fabric materials 26, 26' to be trapezoidal in shape for accommodating the natural taper of human thighs. Only first sleeve member 12 is illustrated in FIGS. 7–9 to show the use of alternative types of connectors because sleeve members 12 and 14 are identical for the embodiments shown in FIGS. 7–9.

Another embodiment of the invention is illustrated in FIG. 4 wherein first sleeve member 12' is illustrated. The second sleeve member to be used with sleeve member 12' is identical in construction to sleeve member 12' and is not illustrated.

Sleeve member 12' is comprised of a conventional first fabric material 26" of natural or artificial fabric. Fabric material 26" is comprised of a first fabric member 58 and a second fabric member 60 conventionally connected to first fabric member 58, such as by sewing the two pieces together along line 62.

Upper edges 64, 66 of fabric members 58, 60 define an exterior obtuse angle A and lower edges 68, 70 of fabric members 58, 60 define an interior obtuse angle B, which is preferably equal to angle A. The overall shape of sleeve member 12', as formed by fabric members 58, 60, accommodates the natural taper of a human thigh when sleeve member 12' is positioned around the thigh.

Connectors or first means 16' are identical to connectors 16, 18 previously described. Likewise, the alternative embodiments for the connectors, as shown in FIGS. 7–9, can be used in sleeve member 12'. Various additional types of conventional connectors, not shown and described herein, can be used as connectors 16' and as the corresponding connectors for the second sleeve member (not shown) corresponding to sleeve member 12'.

The manner of use of garment 10 will be apparent from the previous description. Garment 10 is worn with each thigh fitted into a sleeve and with the belt, waistband or support 20 adjusted and secured around the person's waist. Front and rear support straps 22, 22', 24 and 24' are conventionally adjusted to the desired length to support the sleeves at the desired height on the wearer's thighs.

The sleeves can be adjusted to accommodate thighs of different sizes and to allow the sleeves to be tightened or loosened around the wearer's thighs for a comfortable fit. Garment 10 can be worn out of sight and underneath every day clothes and can be worn with any type of conventional undergarment.

The invention in its broader aspects is not limited to the specific details shown and described, and departures may be made from such details without departing from the principles of the invention and without sacrificing its chief advantages.

What is claimed is:

1. A thigh anti-chafing garment, comprising:

first and second sleeve members for positioning around the thighs of a human;

first means in operative relationship with said first sleeve member for adjusting the fit of said first sleeve member around a first thigh of said human to enable said sleeve member to fit tightly or loosely around said first thigh;

second means in operative relationship with said second sleeve member for adjusting the fit of said second sleeve member around a second thigh of said human to enable said sleeve member to fit tightly or loosely around said second thigh;

a first support for positioning around the waist of said human; and at least four additional supports connected between said first support and said first and second sleeve members for supporting said sleeve members around the thighs.

2. A thigh anti-chafing garment, comprising:

first and second sleeve members for positioning around the thighs of a human;

a first connector attached to said first sleeve member for enabling adjustment of the fit of said first sleeve member around a first thigh of said human;

a second connector attached to said second sleeve member for enabling adjustment of the fit of said second sleeve member around a second thigh of said human;

a first support for positioning around the waist of said human; and at least four additional supports connected between said first support and said first and second sleeve members for supporting said sleeve members around the thighs.

3. A garment as in claim 2 wherein said first support is an adjustable belt.

4. A garment as in claim 3 wherein said belt is elastic.

5. A garment as in claim 2 wherein said additional supports are adjustable straps for supporting said sleeve members at desired locations on the thighs of the human.

6. A garment as in claim 5 wherein said straps are elastic.

7. A garment as in claim 2 wherein said first sleeve member includes:

first fabric material defining first and second opposed sides and further defining upper and lower edges and first and second opposed side edges extending between said upper and lower edges;

said first connector having a first element attached to said first side of said first fabric material adjacent to said first side edge; and said first connector having a second element attached to said second side adjacent to said second side edge and in operative relationship with said first element for enabling selective connection and disconnection of said first and second elements and for enabling adjustment of the fit of said first sleeve member around said first thigh.

8. A garment as in claim 7 wherein said second sleeve member includes:

second fabric material defining first and second opposed sides and further defining upper and lower edges and first and second opposed side edges extending between said upper and lower edges of said second fabric material;

said second connector having a first element attached to said first side of said second fabric material adjacent to said first side edge of said second fabric material; and said second connector having a second element attached to said second side of said second fabric material adjacent to said second side edge of said second fabric material and in operative relationship with said first element of said second connector for enabling selective connection and disconnection of said first and second elements of said second connector and for enabling adjustment of the fit of said second sleeve member around said second thigh.

9. A garment as in claim 8 wherein said first connector further includes a third element attached to said second side of said first fabric material in spaced-apart relationship with said second side edge of said first fabric material for enabling selective connection and disconnection of said first and third elements of said first connector and for enabling adjustment of the fit of said first sleeve member around said first thigh.

10. A garment as in claim 9 wherein said second connector further includes a third element attached to said second side of said second fabric material in spaced-apart relationship with said second side edge of said second fabric material for enabling selective connection and disconnection of said first and third elements of said second connector and for enabling adjustment of said second sleeve member around said second thigh.

11. A garment as in claim 10 wherein said first and second connectors are each comprised of hook and loop material.

12. A garment as in claim 10 wherein said first and second connectors are each comprised of hooks and eyes.

13. A garment as in claim 10 wherein said first and second connectors are each comprised of buttons and button holes defined in said first and second fabrics, respectively.

14. A garment as in claim 10 wherein said first and second connectors are each comprised of loops and tie elements.

15. A garment as in claim 10 wherein said first and second fabric materials are each substantially trapezoidal in shape for accommodating the natural taper of human thighs.

16. A garment as in claim 10 wherein said first and second fabric materials each comprise:

a first fabric member;

a second fabric member connected to said first fabric member;

said upper edges of said first and second fabric materials being formed by said first and second fabric members and defining an exterior obtuse angle;

said lower edges of said first and second fabric materials being formed by said first and second fabric members and defining an interior obtuse angle; and whereby the shapes of said first and second fabric materials accommodate the natural taper of human thighs.

* * * * *